US006469699B2

(12) United States Patent
Yoshine

(10) Patent No.: US 6,469,699 B2
(45) **Date of Patent: *Oct. 22, 2002**

(54) SAMPLE HOLD CIRCUIT

(75) Inventor: Hiroyuki Yoshine, Kanagawa (JP)

(73) Assignee: Sony Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/097,391

(22) Filed: Jun. 16, 1998

(65) Prior Publication Data

US 2001/0043186 A1 Nov. 22, 2001

(30) Foreign Application Priority Data

Jun. 18, 1997 (JP) ..... 9-161005

(51) Int. Cl.[7] ..... G09G 5/00

(52) U.S. Cl. ..... 345/206; 345/204; 345/212; 345/213

(58) Field of Search ..... 345/98–100, 204, 345/206, 212, 213, 80, 205

(56) References Cited

U.S. PATENT DOCUMENTS

| | | | | | |
|---|---|---|---|---|---|
| 5,369,417 | A | * | 11/1994 | Tanaka | 345/98 |
| 5,602,561 | A | * | 2/1997 | Kawaguchi et al. | 345/99 |
| 5,680,149 | A | * | 10/1997 | Koyama et al. | 345/98 |
| 5,745,093 | A | * | 4/1998 | Tsuzuki et al. | 345/103 |
| 5,874,934 | A | * | 2/1999 | Ito | 345/98 |
| 6,011,534 | A | * | 1/2000 | Tanaka et al. | 345/98 |
| 6,049,318 | A | * | 4/2000 | Ota | 345/93 |
| 6,144,355 | A | * | 11/2000 | Murata et al. | 345/99 |

* cited by examiner

*Primary Examiner*—Richard Hjerpe
*Assistant Examiner*—Henry N. Tran
(74) *Attorney, Agent, or Firm*—Jay H. Maioli

(57) ABSTRACT

In a horizontal driving system of a liquid crystal display, the high frequency of a master clock MCLK and complex wiring to an external substrate for transmitting the master clock MCLK cause disadvantageous unwanted radiation. A sample and hold circuit for sampling and holding a video signal based on the master clock MCLK is provided with a built-in PLL circuit for generating the master clock MCLK in order to eliminate complex wiring for transmitting the master clock MCLK and to reduce unwanted radiation.

6 Claims, 3 Drawing Sheets

SAMPLE HOLD CIRCUIT

BACKGROUND OF THE INVENTION

1. Field of the Invention

This invention relates to a sample and hold circuit for sample-holding a video signal based on a master clock, and more particularly to a sample and hold circuit to use suitably for a horizontal driving system of a liquid crystal display device.

2. Description of Related Art

Some liquid crystal display (LCD) devices have the structure in which a video signal is simultaneously inputted using multi-channels in order to reduce driving frequency of an LCD panel. In a horizontal driving system of liquid crystal display devices of this sort, a sample hold circuit for sampling simultaneously multi-bits (pixels) corresponding to the number of channels is used in order to input a video signal using multi-channels.

A conventional example of a sample and hold circuit used for a horizontal driving system of a liquid crystal display device of 6-dot simultaneous sampling is shown in FIG. 5. In this drawing, the sample and hold circuit 100 comprises a inversion amplifier 101 for inverting an input video signal, six sample hold units (SH1 to SH6) 102 to 107 corresponding to 6 channels which receive an output signal from the inversion amplifier 101, and SHP generation circuit 108 for generating 6 types of sample hold pulses SHP1 to SHP6 corresponding to six sample hold units 102 to 107 based on a master clock MCLK given from the outside, and the sample and hold circuit 100 is IC (Integrated Circuit) structured.

A PLL (Phase-Locked Loop) circuit 110 for supplying a master clock MCLK is provided to the sample and hold circuit 100 as an external circuit. The PLL circuit 110 generates a master clock MCLK synchronously to a horizontal sync signal HSYNC namely a comparison reference signal. For 6-dot simultaneous sampling, the master clock MCLK is oscillated at a frequency 12 times that of the horizontal clock HCK which is used as a reference of horizontal scanning of the LCD.

Because, for example, the conventional sample and hold circuit used for a horizontal driving system of a 6-dot simultaneous sampling liquid crystal display device has the structure in which the master clock MCLK is transmitted from a PLL circuit 110 provided as a separate external circuit to the sample and hold circuit, the structure is inevitably provided with wiring for transmitting the master clock MCLK to an external substrate, and in an exemplary 6-dot simultaneous sampling, because frequency of the master clock MCLK is 12 times that of the horizontal clock HCK, the high frequency causes a problem of unwanted radiation. To reduce the unwanted radiation, additional parts dedicated for reduction of the unwanted radiation are required, and the number of parts of the circuit increases resulting in increased cost.

The present invention is accomplished in view of the above-mentioned problem, it is the object of the present invention to provide a sample and hold circuit with reduced unwanted radiation which does not require complex wiring for transmitting the master clock MCLK.

SUMMARY OF THE INVENTION

A sample and hold circuit in accordance with the present invention is a sample and hold circuit for sample-holding a video signal based on a master clock, and has the structure having a PLL circuit for generating a master clock synchronously to a comparison reference signal supplied from the external provided on the common substrate.

In the sample and hold circuit having the above-mentioned structure, the structure that the PLL circuit is provided on the common substrate and contained in the common IC allows the complex wiring to the external substrate for transmitting the master clock generated by the PLL circuit to be eliminated. Unwanted radiation due to complex wiring is reduced and need for parts to prevent unwanted radiation is eliminated in spite of high frequency of the master clock.

DETAILED DESCRIPTION OF THE PREFERRED EMBODIMENTS

Figure 1:
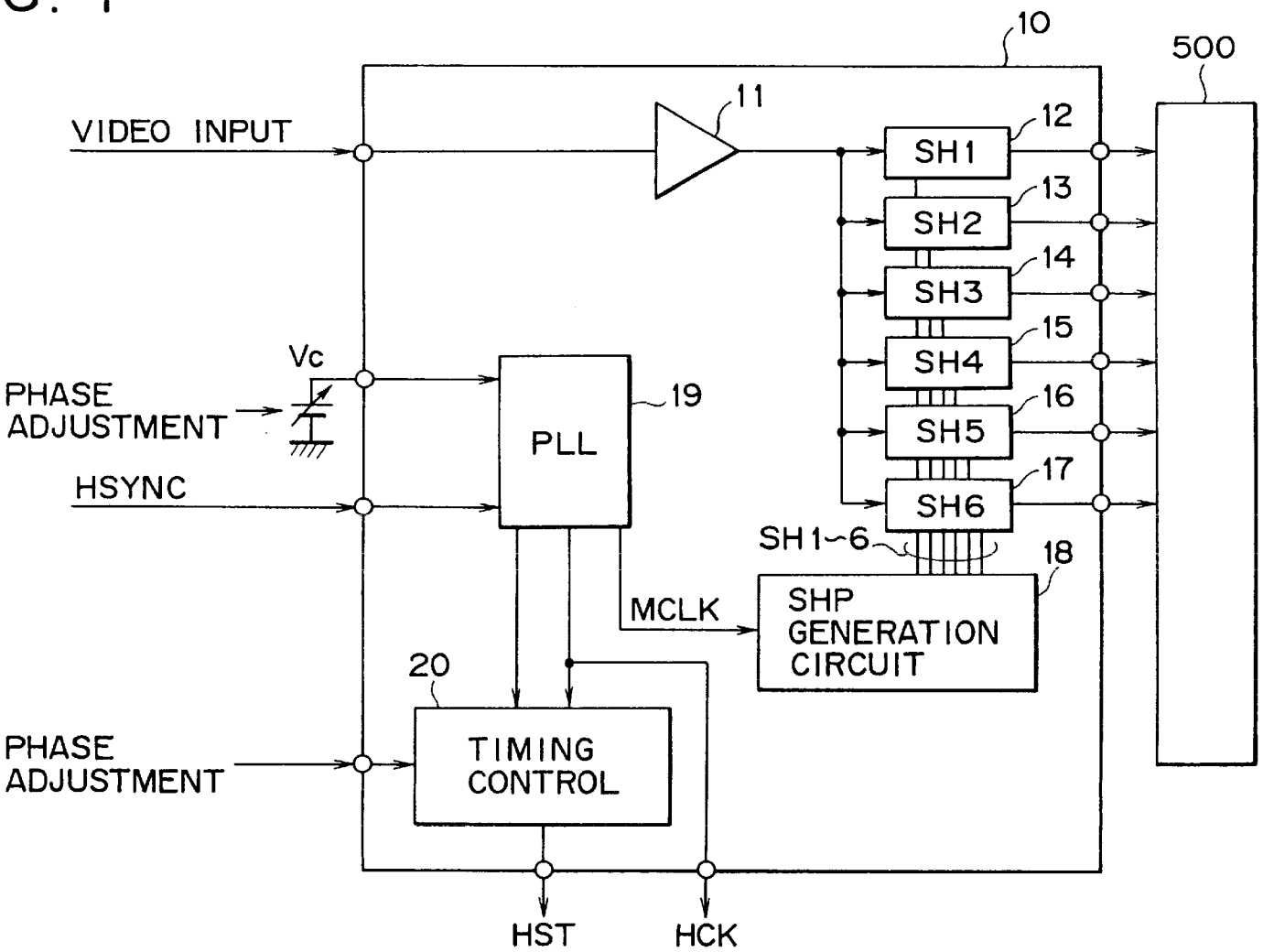
FIG. 1 is a block diagram for illustrating an embodiment of the present invention.

Embodiments of the present invention will be described in detail hereinafter with reference to the drawings. FIG. 1 is a block diagram f or illustrating a sample and hold circuit in accordance with the present invention used, for example, for a horizontal driving system of a 6-dot simultaneous sampling liquid crystal display device.

In FIG. 1, the sample and hold circuit 10 in accordance with the present invention has the structure provided with an inversion amplifier 11, six sample and hold units (SH1 to SH6) 12 to 17, and an SHP generation circuit 18, and has a PLL circuit 19 on the common substrate (chip) (built-in). The sample and hold circuit 10 has an IC structure. In the sample and hold circuit 10, the inversion amplifier 11 inverts an input video signal, and inputs it to six sample hold units 12 to 17 corresponding to 6 channels. The sample and hold circuit 10 supplies the sample-held video signal to a liquid crystal panel 500 based on the sample and hold pulses SH1 to SH6. A video signal having the phase adjusted with respect to the horizontal sync signal is supplied to the liquid crystal panel 500 through 6 signal lines.

Figure 2:
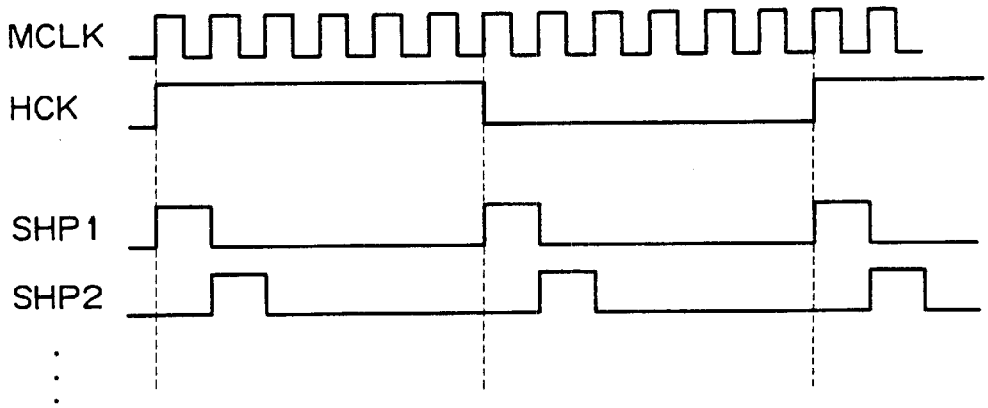
FIG. 2 is a timing chart for showing the timing relation between the sample hold pulse SHP and master clock MCLK.

The SHP generation circuit 18 generates successively 6 types of sample and hold pulses SHP1 to SHP6 corresponding to 6 sample hold units 12 to 17 for every one clock of the master clock MCLK generated by the PLL circuit 19 as shown in the timing chart of FIG. 2. As the result, the phase of sample hold pulses SHP1 to SHP6 is shifted successively by a period of the master clock MCLK. The PLL circuit 19 generates the master clock MCLK to be supplied to the SHP generation circuit 18 based on the horizontal sync signal HSYNC namely the comparison reference signal provided externally.

Figure 3:
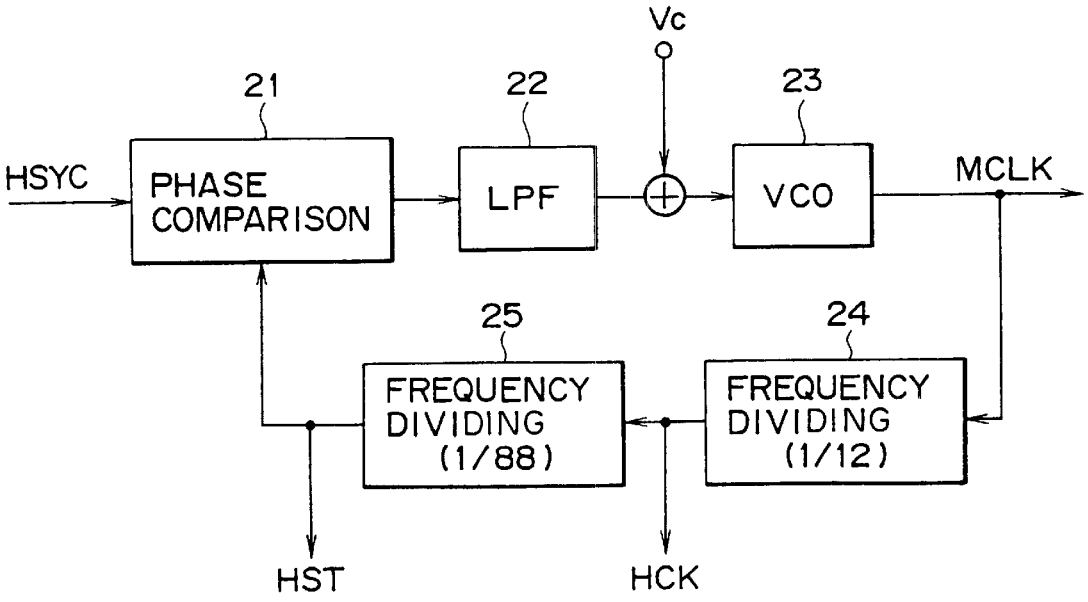
FIG. 3 is a block diagram for illustrating an exemplary circuit structure of a PLL circuit.

One example of the circuit structure of the PLL circuit 19 is shown in FIG. 3. As shown in the drawing, the PLL circuit 19 comprises a phase comparison circuit 21 which uses the horizontal sync signal HSYNC as the comparison reference signal, a LPF (Low Pass Filter) 22 for removing AC component of comparison output of the phase comparison circuit 21, a VCO (Voltage Control Oscillator) 23 which uses DC voltage supplied form the LPF 22 as the control voltage, a frequency divider 24 for dividing the oscillation output of the VCO 23 into 12, and a frequency divider 25 for dividing the frequency divided output from the frequency divider 24 into 88 namely the frequency of the horizontal sync signal HXYNC and supplying it to the phase comparison circuit 20.

In the PLL circuit 19, the oscillation output of the VCO 23 is outputted as the master clock MCLK to be supplied to the SHP generation circuit 18. The frequency divided output of the frequency divider 24 is outputted as the horizontal clock HCK which is 1/12the frequency of the master clock MCLK. The horizontal clock HCK is used as the scanning timing reference in the horizontal scanning system of the LCD. The frequency divided output of the frequency divider 25 is outputted as the horizontal start pulse HST having a frequency equal to that of the horizontal sync signal HSYNC. The horizontal start pulse HST is used as a reference to determine the position in the right-left direction (horizontal direction) on a picture displayed on the LCD.

The PLL circuit 19 has phase adjusting function to adjust arbitrarily the master clock MCLK with respect to the horizontal sync signal HSYNC. In detail, when an adjusting voltage Vc corresponding to phase adjusting information is provided externally, the adjusting voltage Vc is added to the DC output voltage of the LPF 22 in the PLL circuit 19, and the added voltage is supplied to the VCO 23 as a control voltage to perform phase adjustment of the master clock MCLK with respect to the horizontal sync signal HSYNC. As the result, phase of the master clock MCLK is adjusted so as to be optimal for each device.

Figure 4:
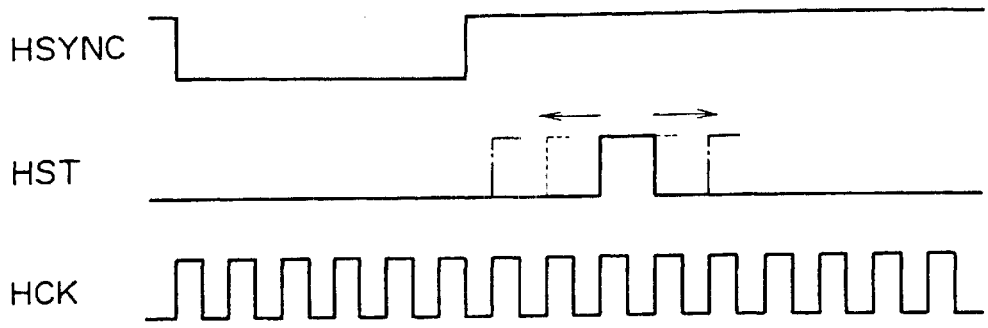
FIG. 4 is a timing chart for describing the timing control concept of the horizontal start pulse HST.
Figure 5:
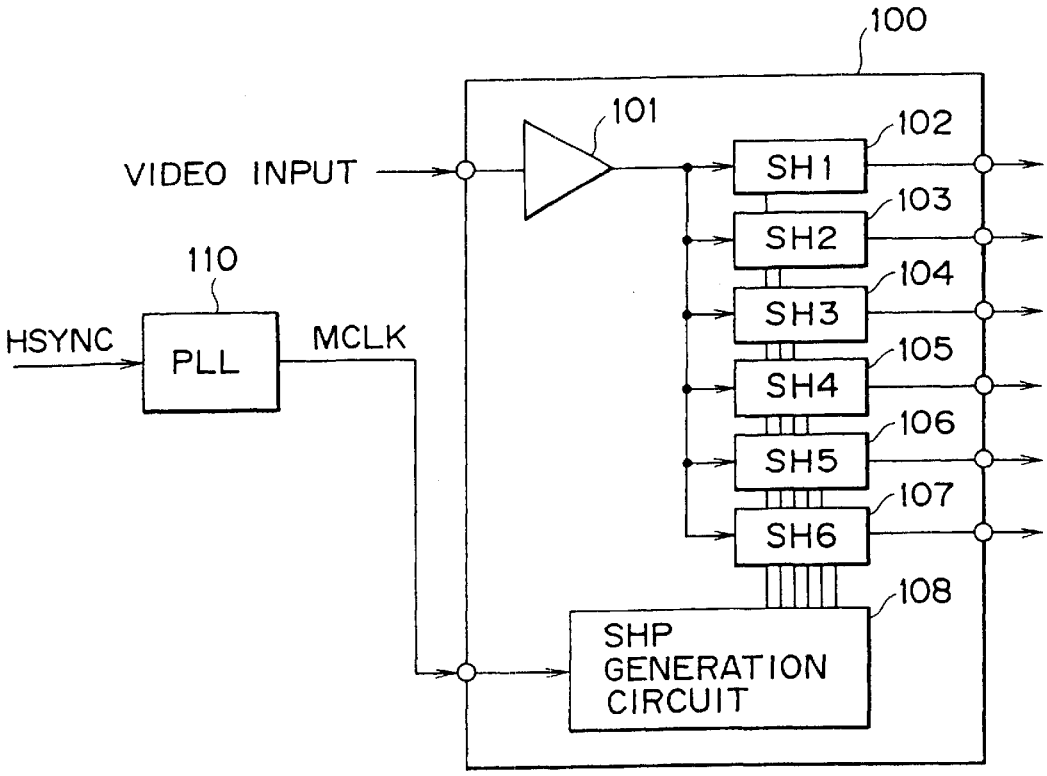
FIG. 5 (PRIOR ART)
FIG. 5 is a block diagram for illustrating a conventional example.

The sample and hold circuit 10 is provided with a built-in timing control circuit 20 for controlling the timing of the horizontal start pulse HST synchronously to the horizontal clock HCK. The timing control circuit 20 functions to put the horizontal pulse HST outputted from the PLL circuit 19 ahead or back on the time axis by the number of clocks corresponding to the position adjusting information with reference to the horizontal clock HCK as shown in the timing chart of FIG. 4.

Because the horizontal start pulse HST is the reference to determine the picture position in the horizontal direction on the LCD as described hereinbefore, by providing the built-in timing control circuit 20 for controlling the timing of the horizontal start pulse HST and by setting arbitrarily the position adjusting information provided externally, the sample hold circuit 10 is allowed to have the function for adjusting arbitrarily the position in the horizontal direction of the displayed picture on the LCD. As the result, the position of the displayed picture can be set arbitrarily.

As described herein above, by providing the built-in PLL circuit 19 for generating the master clock MCLK on the IC-structured sample hold circuit 10 in a LCD for, for example, 6-dot simultaneous sampling of a video signal, complex line wiring to the external substrate for transmitting the master clock MCLK to the sample and hold circuit 10 is unnecessary unlike the conventional art, in which the PLL circuit is provided externally.

Unwanted radiation due to complex wiring is reduced regardless of high frequency of the master clock. In this embodiment, application of the present invention to a horizontal driving system of a liquid crystal display device of 6-dot simultaneous sampling is assumed, the frequency of the master clock MCLK is 12 time that of the horizontal clock HCK, and for the liquid crystal display device of 12 dot simultaneous sampling, the master clock MCLK having a very high frequency 24 times that of the horizontal clock HCK is required, in such case the present invention is very effective for preventing unwanted radiation.

Because the built-in PLL circuit 19 prevents unwanted radiation, parts dedicated to prevent unwanted radiation can be eliminated, and the elimination contributes to reduce the cost. Further, wiring lines to transmit the master clock MCLK are eliminated, so the space for the wiring is unnecessary, and the area size of the external substrate is reduced.

The above-mentioned embodiment involves application of the present invention to a 6-dot simultaneous sampling liquid crystal display device, however, the present invention is by no means limited to the case, but is applied to a 12 dot simultaneous sampling liquid crystal display device similarly.

As described hereinbefore, according to the present invention, in a sample and hold circuit for sample holding of a video signal based on the master clock, because a built-in PLL circuit for generating the master clock is provided, complex wiring for transmitting the master clock to an external substrate is unnecessary, and unwanted radiation due to complex wiring is reduced.

What is claimed is:

1. A sample and hold circuit comprising:

a common substrate;

a sample and hold pulse generation circuit formed on said common substrate for generating a plurality of sample and hold pulses for sampling and holding a video signal, wherein a phase of said plurality of sample and hold pulses is shifted successively by a period of a master clock;

a PLL circuit for generating said master clock in synchronism with a comparison reference signal provided externally and for generating a horizontal start pulse for use as a reference to determine a horizontal position of a displayed picture based on said video signal by dividing said master clock, wherein said PLL circuit is formed on said common substrate so that unwanted radiation is reduced regardless of a high frequency of said master clock; and a plurality of sample and hold units formed on said common substrate and having as inputs said video signal and said plurality of sample and hold pulses.

2. The sample and hold circuit as claimed in claim 1, wherein said PLL circuit adjusts a phase of said master clock based on an externally provided signal.

3. The sample and hold circuit as claimed in claim 1, further comprising means for controlling the timing of said horizontal start pulse based on said externally provided signal.

4. A liquid crystal display device comprising:

a sample and hold circuit including:

a common substrate, a sample and hold pulse generation circuit formed on said common substrate for generating a plurality of sample and hold pulses for sampling and holding a video signal, wherein a phase of said plurality of sample and hold pulses is shifted successively by a period of a master clock, a PLL circuit for generating said master clock in synchronism with a comparison reference signal provided externally and for generating a horizontal start pulse for use as a reference to determine a horizontal position of a displayed picture based on said video signal by dividing said master clock, wherein said PLL circuit is formed on said common substrate so that unwanted radiation is reduced regardless of a high frequency of said master clock;

a plurality of sample and hold units formed on said common substrate and having as inputs said video signal and said plurality of sample and hold pulses; and a liquid crystal panel for displaying an output from said plurality of sample and hold units.

5. The liquid crystal display device as claimed in claim 4, wherein said PLL circuit adjusts a phase of said master clock based on an externally provided signal.

6. The liquid crystal display device as claimed in claim 4, further comprising means for controlling the timing of said horizontal start pulse based on said externally provided signal.

* * * * *